US005761907A

United States Patent [19]

Pelletier et al.

[11] Patent Number: 5,761,907

[45] Date of Patent: Jun. 9, 1998

[54] THERMAL GRADIENT DISPERSING HEATSHIELD ASSEMBLY

[75] Inventors: Robert R. Pelletier, Chardon; Kiran Patwari, Highland Heights, both of Ohio

[73] Assignee: Parker-Hannifin Corporation, Cleveland, Ohio

[21] Appl. No.: 720,252

[22] Filed: Sep. 26, 1996

Related U.S. Application Data

[60] Provisional application No. 60/008,482 Dec. 11, 1995.

[51] Int. Cl.[6] ..... F02C 1/00

[52] U.S. Cl. ..... 60/740; 60/748; 60/39.32; 239/397.5; 239/406

[58] Field of Search ..... 60/740, 748, 39.32; 239/403, 405, 406, 423, 425.5, 397.5

[56] References Cited

U.S. PATENT DOCUMENTS

| | | | |
|---|---|---|---|
| 3,638,865 | 2/1972 | McEneny et al. . | |
| 4,754,922 | 7/1988 | Halvorsen et al. | 239/406 |
| 4,854,127 | 8/1989 | Vinson et al. . | |
| 4,938,417 | 7/1990 | Halvorsen | 239/406 |
| 5,044,559 | 9/1991 | Russel et al. | 239/406 |
| 5,102,054 | 4/1992 | Halvorsen . | |
| 5,127,346 | 7/1992 | Kepplinger et al. | 239/403 |
| 5,269,468 | 12/1993 | Adiutori . | |
| 5,307,635 | 5/1994 | Graves et al. . | |
| 5,423,178 | 6/1995 | Mains . | |

*Primary Examiner*—Charles G. Freay
*Attorney, Agent, or Firm*—Christopher H. Hunter

[57] ABSTRACT

An airblast fuel nozzle has an injector head with an outer air flow through an outer air flow swirler, an intermediate fuel flow through an intermediate fuel swirler, and an inner air flow through an inner air swirler. A heatshield assembly protects the intermediate fuel swirler from hot air passing through the inner air swirler. The heatshield assembly includes an inner heatshield extending from the inlet end of the fuel swirler to the outlet end of the fuel swirler, and an intermediate heatshield disposed between the inner heatshield and the fuel swirler. According to one embodiment, the inner heatshield is connected, such as by brazing, at its downstream end to the intermediate heatshield, and at its upstream end to the fuel swirler. The upstream connection to the fuel swirler is preferably at or downstream from the midpoint of the fuel swirler. An air gap is provided between the inner heatshield and the intermediate heatshield, and between the intermediate heatshield and the fuel swirler. According to a second embodiment, the intermediate heatshield is connected at its downstream end to the downstream end of the fuel swirler, and at its upstream end to the inner heatshield, at a location at or downstream from the midpoint of the inner heatshield. An air gap is also provided between the inner heatshield and the intermediate heatshield, and between the intermediate heatshield and the fuel swirler. The intermediate heatshield allows axial and radial expansion of the inner heatshield without affecting the fluid flow through the fuel passage or the inner air passage, has reduced stress concentration at the connection point, and has increased cycle life without fatigue failure.

12 Claims, 2 Drawing Sheets

THERMAL GRADIENT DISPERSING HEATSHIELD ASSEMBLY

This application claims the benefit of U.S. Provisional application Ser. No. 60/008,482, filing data, Dec. 11, 1995.

FIELD OF THE INVENTION

The present invention relates generally to fuel nozzle construction, and more particularly to a heatshield assembly for an airblast fuel nozzle of a gas turbine engine.

BACKGROUND OF THE INVENTION

Airblast fuel nozzles for gas turbine engines typically have an injector head with generally concentric chambers for inner air flow, intermediate fuel flow, and outer air flow, and generally concentric discharge orifices for discharging and intermixing the inner and outer air flows and fuel flow in the combustor. The discharge air atomizes a thin film of fuel for the combustion process. A tubular extension or support strut extends from the head of the injector for attachment to the casing of the engine to support the tip of the injector relative to the combustor casing. A central fuel passage extends through the extension to supply pressurized fuel to the injector. Halvorsen, U.S. Pat. No. 5,102,054 describes and illustrates this type of airblast fuel nozzle.

During certain engine operating conditions, the air passing through the inner air passage in the nozzle can cause the wetted wall temperatures in the fuel passage to exceed 400° F. (200° C.). At this point, the fuel begins to break down into various components, one being carbon or coke. The coke can build up on the walls of the fuel passage and restrict fuel flow, thus effecting the efficiency of the engine. For this reason, a heatshield is typically located within the inner air passage to keep the wetted wall temperatures of the fuel passage below the fuel coking point.

A common inner air heatshield has a metal sleeve which is attached at one end to the fuel bearing port (fuel swirler). The other end of the heatshield is unattached and has a clearance gap which allows the heatshield to grow in axial and radial directions during thermal expansion induced by the high temperature operating conditions. As illustrated in FIG. 1, some inner air heatshields are joined at "A" to the fuel swirler at the upstream end of the inner air circuit. A clearance gap "B" at the downstream end allows for axial and radial thermal expansion of the heatshield. This type of heatshield is also shown in Halvorsen, U.S. Pat. No. 5,120,054. While this type of heatshield reduces wetted wall temperatures, the heatshield may cause undesirable aerodynamic effects in the inner air passage because of the groove "H" between the end of the inner air heatshield and the surrounding fuel swirler. Axial growth of the heatshield can also change the geometry at or near the fuel injection point into the airstream, which can vary the delivery of the fuel to the combustion chamber. As such, this type of heatshield can be undesirable in some applications.

Another technique for connecting the heatshield to the fuel swirler is to connect the heatshield at its downstream end "C" to the fuel swirler, as illustrated in FIG. 2. The upstream end of the heatshield is unattached, and a clearance gap "D" is provided for axial and radial expansion. This type of heatshield provides a smooth transition between the heatshield and the fuel swirler, which eliminates disruption of air flow and a changing geometry at the fuel injection point. However, the downstream connection between the heatshield and the fuel swirler can have unacceptable thermal stress concentration because of the large thermal gradient across the hot heatshield and substantially cooler fuel swirler. Continued cycling of the engine can cause premature failure of this joint. As such, this type of heatshield can also be undesirable in certain applications.

As such, it is believed that there is a demand in the industry for an airblast fuel injector with an inner heatshield which provides adequate thermal protection for the nozzle, has reduced stress concentration at the connection with the fuel swirler, does not disrupt flow geometry within the inner air circuit or at the fuel injection point, and thereby has an increased cycle life.

SUMMARY OF THE INVENTION

The present invention provides a novel and unique fuel nozzle for a gas turbine engine, and more particularly provides an novel and unique heatshield assembly for the injector head of the nozzle. The heatshield assembly includes an inner heatshield similar to a conventional inner heatshield for thermal protection of the nozzle, but which is connected to the fuel swirler via an intermediate heatshield to spread out the thermal gradient between the inner heatshield and the fuel swirler, According to the present invention, the injector head includes an outer housing and a fuel swirler which together define an annular fuel swirl path through the head. One or more outer air swirler are disposed radially outward from the housing to direct outer air flow in a swirling manner. An inner air flow passage is provided centrally through the injector head and includes air swirlers to direct air in a swirling manner through the injector head. The inner air heatshield for the inner air flow passage has a cylindrical shape and extends from the downstream air discharge orifice of the injector head to the upstream air inlet. A clearance gap is provided between the upstream end of the inner heatshield and the housing for relative axial and radial growth therebetween.

The intermediate heatshield is also cylindrical and is disposed in surrounding, concentric relation to the inner heatshield at the downstream air discharge orifice of the injector head. According to a first embodiment of the present invention, the intermediate heatshield is connected at its upstream end, such as by brazing, to the fuel swirler, at a location on the fuel swirler which is spaced upstream from the fuel discharge orifice of the fuel swirler, and preferably at a location which is at or downstream from the midpoint of the fuel swirler. The downstream end of the intermediate heatshield is also connected, such as by brazing, to the inner heatshield at the downstream end of the inner heatshield. An insulating air gap is provided between the intermediate heatshield and the fuel swirler and a clearance gap is provided between the downstream end of the intermediate heatshield and the downstream end of the fuel swirler. An insulating air gap is also provided between the intermediate heatshield and the inner heatshield.

According to a second embodiment of the present invention, the intermediate heatshield can be connected to the fuel swirler at the downstream discharge orifice of the fuel swirler. The upstream end of the intermediate heatshield is then connected to the inner heatshield at a location spaced from the downstream end of the inner heatshield, and preferably at a location which is downstream from the midpoint of the inner heatshield. An air gap is provided between the intermediate heatshield and the inner heatshield, and between the intermediate heatshield and the fuel swirler. A clearance gap is also provided between the downstream end of the intermediate heatshield and the downstream end of the inner air heatshield.

According to either of the embodiments described above, the intermediate heatshield spreads out the thermal gradient between the inner heatshield and the fuel swirler which reduces the stress concentration at the connection points between the inner heatshield, intermediate heatshield, and fuel swirler. The inner heatshield is allowed axial and radial thermal expansion while providing smooth flow geometry through the inner air passage and at the fuel injection point of the injector head. The above factors provide increased cycle life without fatigue failure.

Further features and advantages of the present invention will become further apparent upon reviewing the following specification and accompanying drawings.

DETAILED DESCRIPTION OF THE PREFERRED EMBODIMENT

Figure 3:
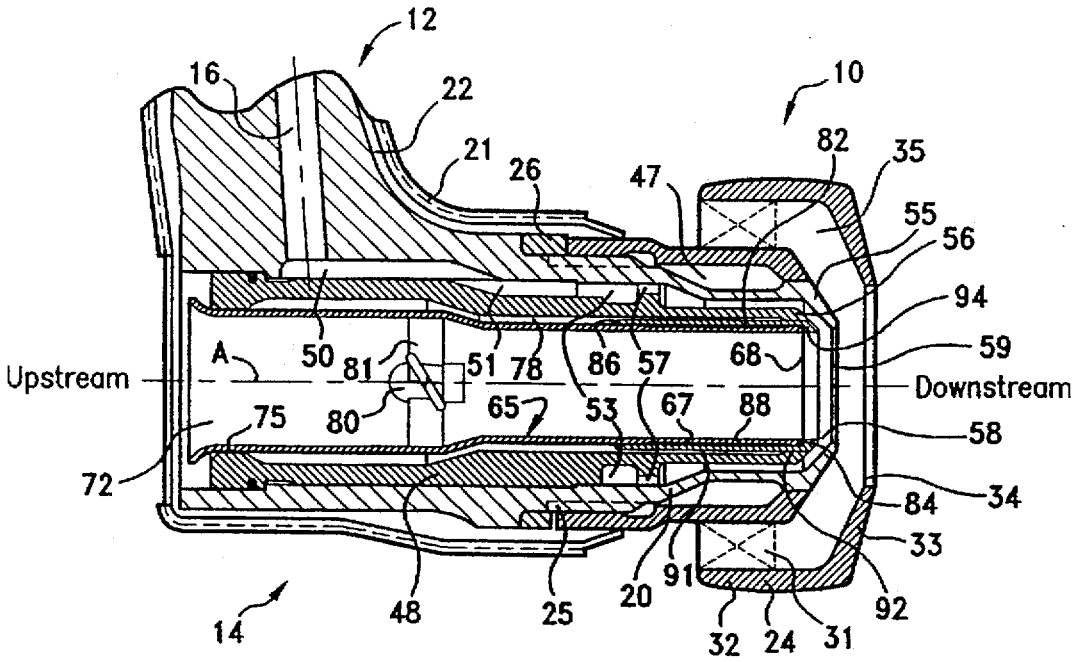
FIG. 3 is a longitudinal cross-sectional view of one embodiment of an airblast fuel nozzle constructed according to the principles of the present invention.

Referring to the drawings, and initially to FIG. 3, an airblast fuel nozzle constructed according to one preferred embodiment of the present invention is indicated generally at 10. The airblast fuel nozzle 10 includes an extension or housing stem, indicated generally at 12, and an injector head, indicated generally at 14. The housing stem 12 is preferably formed from an appropriate high-temperature corrosion-resistant alloy (e.g., Hast-X metal) and is attached at its upstream end to the combustor casing of the engine to support the injector head 14 within the casing. Housing stem 12 includes an inlet fuel passage 16 extending centrally tough the housing stem. Passage 16 directs pressurized fuel from an upstream fuel pump (not shown) to the injector head 14.

The downstream end of housing stem 12 includes an annular housing tip 20 preferably formed in one piece with housing stem 12 and circumscribing the longitudinal axis "A" of the injector head. An external heatshield 21 surrounds the downstream tip 20. The external heatshield 21 provides an insulating air gap 22 along at least a portion of tip 20. An outer air swirler 24 is attached (e.g., threaded at 25 and tig welded one or two places with a retaining ring 26) to housing tip 20 and extends downstream therefrom. Swirler vanes 31 extend radially outward on the downstream end of the outer air swirler 24 to an annular shroud 32. The annular shroud 32 tapers inwardly at its distal end 33 toward the axis A of the injector head and forms an annular air discharge orifice 34. The swirler vanes 31 direct the air flow in a swirling manner through frusto-conical passage 35 leading to discharge orifice 34. An insulating air gap 47 is provided between outer air swirler 24 and downstream housing tip 20 for high temperature protection. Outer air swirler 24 is also preferably formed from an appropriate high-temperature, corrosion resistant alloy (e.g., HAST-X metal).

A fuel swirler 48 is disposed radially inward of shroud tip 20 and is attached at 49 (such as by brazing) to the upstream portion of housing tip 20. A fuel passage 50 is defined between fuel swirler 48 and housing stem 12 and directs fuel downstream from inlet fuel passage 16. A slot 51 allow fuel to pass along from fuel inlet passage 50 to a downstream annulus 53 defined between the downstream end 55 of shroud tip 20 and the downstream end 56 of fuel swirler 48. The fuel swirler further includes spiral blades 57 extending radially outward from the fuel swirler to the shroud. Spiral blades 57 direct fuel in a swirling manner from the annulus 53 through frusto-conical passage 58 leading to an annular fuel discharge orifice 59. The fuel swirler is also formed from an appropriate high-temperature, corrosion-resistant alloy (e.g., HAST-X metal).

Finally, a heatshield assembly, indicated generally at 65, is disposed radially inward from fuel swirler 48. Heatshield assembly 65 includes an inner cylindrical heatshield 67 which extends from a downstream air outlet orifice 68 at the downstream end of the fuel swirler, to an upstream air inlet orifice 72 of the upstream end of the fuel swirler. An annular clearance or gap 75 is provided between the upstream end of the heatshield 67 and the fuel swirler for axial and radial thermal expansion of inner heatshield 67. In addition, an insulating air gap 78 is provided between inner heatshield 67 and fuel swirler 48 for appropriate heat protection therebetween.

An inner air swirler 80 is disposed centrally within the interior of heatshield 67. Inner air swirler 80 includes vanes 81 extending radially outward and connected (e.g., brazed or welded) to the interior surface of the heatshield. Inner air swirler 80 directs air received through upstream end inlet orifice of the heatshield assembly in a swirling manner through downstream outlet orifice 68.

Inner heatshield 67 is fixedly secured to fuel swirler 48. To this end, an intermediate cylindrical heatshield 82 is disposed between inner heatshield 67 and fuel swirler 48, at the downstream end of these components. Intermediate heatshield 82 spreads out the heat gradient between inner heatshield 67 and fuel swirler 48 during operation of the engine. According to this first embodiment, intermediate heatshield 82 is secured, e.g., brazed, at its downstream end 84 to the downstream end of inner heatshield 67. The intermediate heatshield is likewise attached, e.g., brazed, at its upstream end 86 to a point which is spaced from the downstream end 56 of the fuel swirler, and preferably at a point which is at or downstream from the midpoint of the fuel swirler. The axial length of the intermediate heatshield within air gap 78 is preferably as short as possible to reduce material and fabrication costs, but yet is long enough to provide thermal protection between the inner heatshield 67 and fuel swirler 48.

Intermediate heatshield 82 extends axially within air gap 78 and provides an insulating inner air gap 88 between intermediate heatshield 82 and inner heatshield 67, and an insulating outer air gap 91 between intermediate heatshield 82 and fuel swirler 48. A clearance gap 92 is provided between the downstream end of the intermediate heatshield 82 and the fuel swirler 48 to allow for relative axial and radial thermal expansion therebetween. The intermediate heatshield can have a radially-inward projecting annular lip 94 at its downstream end which has an inner surface which is flush with the inner surface of inner heatshield 67 for smooth flow thereacross, and preferably lip 94 forms a part of the air outlet orifice.

Figure 1:
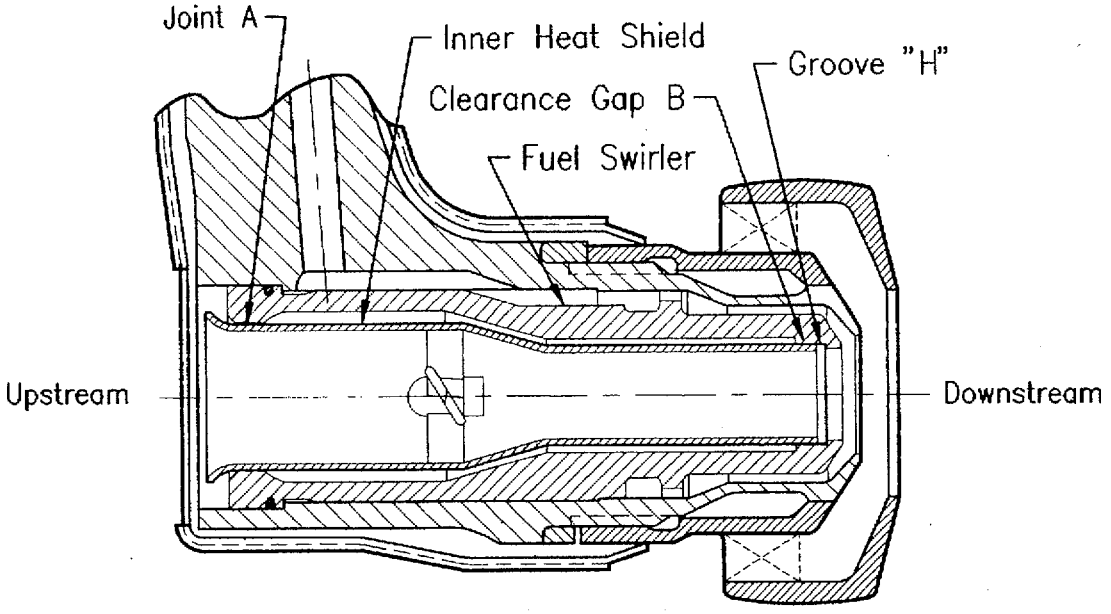
Fig. 1 (PRIOR ART)
FIG. 1 is a longitudinal cross-sectional view of one prior art embodiment of an airblast fuel nozzle, with the inner heatshield connected directly to the fuel swirler at the upstream end of the inner heatshield.
Figure 2:
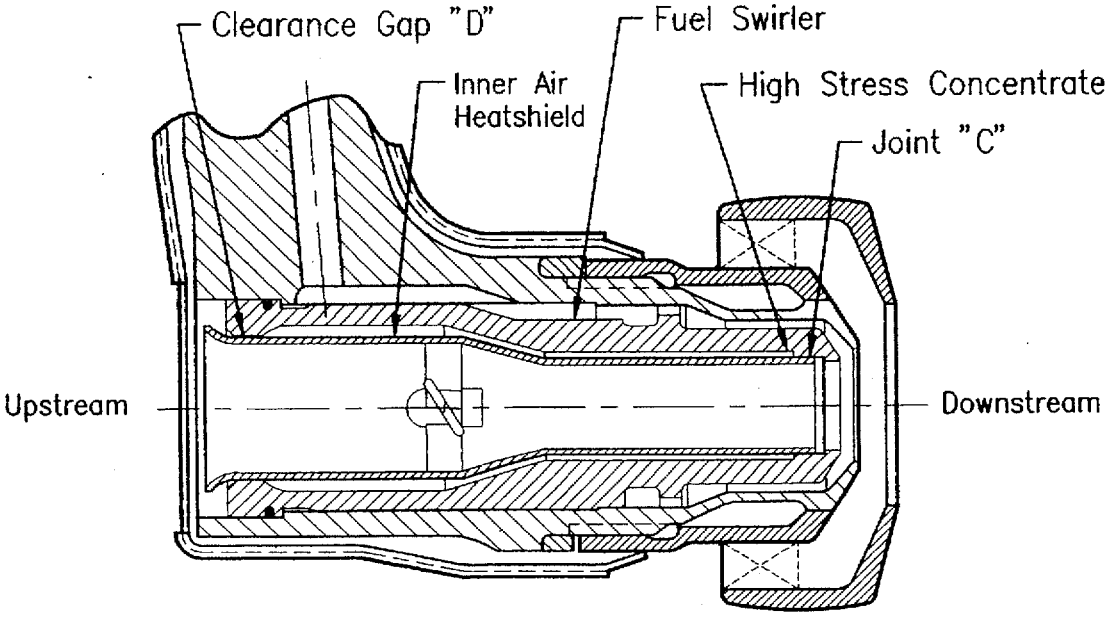
Fig. 2 (PRIOR ART)
FIG. 2 is a longitudinal cross-sectional view of another prior art embodiment of an airblast fuel nozzle, with the inner heatshield connected directly to the fuel swirler at the downstream end of the inner heatshield.
Figure 4:
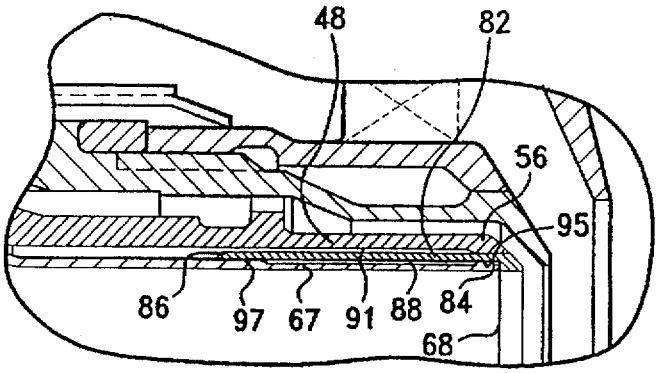
FIG. 4 is a longitudinal cross-sectional enlarged view of a portion of an airblast fuel nozzle constructed according to another embodiment of the present invention.

According to the second embodiment of the invention, illustrated in FIG. 4, intermediate heatshield 82 has its upstream end 86 attached, e.g., brazed, to inner heatshield 67 at a location 97 which is spaced apart from the downstream end 68 of the inner heatshield, and preferably at a point which is at or downstream from the midpoint of the inner heatshield. Intermediate heatshield 82 is also attached, e.g., brazed, at the downstream end 84 of the intermediate heatshield to the downstream end 56 of the fuel swirler 48. Again, an inner insulating air gap 88 is provided between intermediate heatshield 82 and inner heatshield 67, and a clearance gap 95 is provided between the downstream end 68 of the inner heatshield 67 and the downstream end 84 of the intermediate heatshield 82 to allow for relative axial and radial thermal expansion. Likewise, an outer insulating air gap 91 is provided between intermediate heatshield 82 and fuel swirler 48.

In either of the embodiments described above, the intermediate heatshield 82 provides for securely attaching the inner heatshield 67 to the fuel swirler 48 in a manner which reduces the stress concentration between these components. The attachment provides for a smooth geometry between the inner air heatshield and the fuel swirler, and at the point of fuel injection. Inner heatshield 67 prevents the heat in the air flow from being transferred to fuel swirler 48, and thus prevents the wetted wall temperatures of fuel passage 50 (or annular slot 51 or annulus 53) from increasing above the coking point of the fuel. While inner heatshield 67 may grow axially and radially when high temperatures are present in the air flowing through the central air passage, the upstream end 72 of the inner heatshield absorbs these axial and radial expansions. The geometry of the central air passage and the fuel passage is not affected. Further, while intermediate heatshield 82 may have some radial and axial thermal expansion, this expansion is limited because of the preferably short length of the intermediate heatshield, and because of the intermediate location of this heatshield between the inner heatshield 67 and the fuel swirler 48 protecting the intermediate heatshield from extreme temperatures.

Thus, as described above, the present invention provides an airblast fuel injector for gas turbine engines which has an inner heatshield which provides thermal protection for the nozzle, has reduced stress concentration at the connection with the fuel swirler, does not disrupt flow geometry within the inner air circuit or at the fuel injection point, and has an increased cycle life without fatigue failure.

The principles, preferred embodiments and modes of operation of the present invention have been described in the foregoing specification. The invention which is intended to be protected herein should not, however, be construed as limited to the particular form described as it is to be regarded as illustrative rather than restrictive. Variations and changes may be made by those skilled in the art without departing from the scope and spirit of the invention as set forth in the appended claims.

What is claimed is:

1. An injector head of an airblast fuel nozzle, comprising:

an outer housing extending along a longitudinal axis of the injector head, a fuel swirler disposed radially inward from and surrounded by said housing, said fuel swirler defining at least a portion of a fuel passage from a fuel inlet orifice in said injector head to a fuel discharge orifice in said injector head;

a heat shield assembly disposed radially inward from and surrounded by said fuel swirler; and an inner air flow chamber disposed radially inward from and surrounded by said heat shield assembly;

said heat shield assembly including an inner heat shield extending axially along the fuel swirler from an upstream inlet end of the fuel swirler to a downstream discharge end of the fuel swirler to thermally shield the fuel swirler along the inner air flow chamber, and an intermediate heat shield disposed between said inner heat shield and said fuel swirler, said intermediate heat shield connecting said inner heat shield to said fuel swirler to spread out the heat gradient across the interface between said inner heat shield and said fuel swirler.

2. The injector head as in claim 1, wherein said intermediate heat shield connects said inner heat shield to said fuel swirler at a location which is downstream from a midpoint location along the inner heat shield.

3. The injector head as in claim 2, wherein said intermediate heat shield extends axially along a portion of the inner heat shield.

4. The injector head as in claim 3, wherein said inner heat shield has an upstream, unattached end which can axially and radially move upon thermal expansion of said inner heat shield.

5. The injector head as in claim 4, wherein said intermediate heat shield is connected at a downstream end to a downstream discharge end of said inner heat shield.

6. The injector head as in claim 5, wherein said intermediate heat shield is connected at an upstream end to said fuel swirler at a location spaced from a downstream discharge end of said fuel swirler.

7. The injector head as in claim 4, wherein said intermediate heat shield is connected at a downstream end to a downstream discharge end of said fuel swirler.

8. The injector head as in claim 7, wherein said intermediate heat shield is connected at an upstream end to said inner heat shield, at a location spaced from a downstream discharge end of said inner heat shield.

9. The injector head as in claim 4, wherein said inner heat shield extends axially along the length of the fuel swirler.

10. The injector head as in claim 4, wherein said fuel swirler defines a central, annular cavity for said heat shield assembly, said inner heat shield has a cylindrical shape along the length of the fuel swirler, and said intermediate heat shield also has a cylindrical shape intermediate said fuel swirler and said inner heat shield.

11. The injector head as in claim 1, further including an outer air swirler surrounding said housing which provides an air swirl flow path for the airblast nozzle.

12. The injector head as in claim 1, wherein a first air gap is defined between said intermediate heatshield and said fuel swirler, and a second air gap is defined between said intermediate heatshield and said inner heatshield.

* * * * *